United States Patent [19]

Udo

[11] Patent Number: 4,852,120

[45] Date of Patent: Jul. 25, 1989

[54] COOLING APPARATUS FOR ELECTRIC ARC FURNACE ELECTRODES

[75] Inventor: Eigi Udo, Nishinomiya, Japan

[73] Assignee: Nikko Industry Co., Ltd., Kobe, Japan

[21] Appl. No.: 268,446

[22] Filed: Nov. 8, 1988

[51] Int. Cl.[4] ..... H05B 7/12

[52] U.S. Cl. ..... 373/95; 373/96

[58] Field of Search ..... 373/37, 95, 96, 88

[56] References Cited

FOREIGN PATENT DOCUMENTS 29259 of 1914 United Kingdom ..... 373/95

*Primary Examiner*—Roy N. Envall, Jr.

*Attorney, Agent, or Firm*—Edwin E. Greigg

[57] ABSTRACT

A cooling apparatus for electric arc furnace (EAF) electrodes, in which nozzles spray and cool the surfaces of EAF electrodes outside the furnace roof. The water spray cooling is provided around the graphite electrode columns. Water flow is controlled in a way that water running down the electrode columns is evaporated before entering the EAF-roof hole to enable maximum graphite saving and high security.

8 Claims, 2 Drawing Sheets

COOLING APPARATUS FOR ELECTRIC ARC FURNACE ELECTRODES

FIELD OF THE INVENTION AND RELATED ART STATEMENT

1. Field of the Invention

This invention relates to a cooling apparatus for electric arc furnace (EAF) electrodes for reducing consumable electrode unit consumption by preventing the surfaces, especially the side furnaces, of electrodes from being oxidized.

2. Description of the Related Art

Graphite electrodes have been used in electric arc furnace (EAF) and Ladle Furnace so far. Each of the electrodes is clamped by an electrode holder to be inserted into the furnace. An arc is generated between the tip of the electrode and the materials in the furnace to cause the materials to be molten and heated up. The tip of the electrode is sublimated by the arc gradually. At the same time, the side surface at the lower part of the electrode is oxidized and consumed in high temperature atmosphere in the furnace and its shape is changed into that of a pencil, the diameter of the bottom of the electrode being decreased to about 70% as compared with the original electrode diameter.

The above-mentioned electrode consumption can be broken down, in term of figures, into 40% by arc, 5% by fall-down of the tip by thermal shock, 50% by oxidized side surface and 5% by other causes.

As compared with the electrode consumption by an arc when melting and heating scraps which is the main aim to use a graphite electrode, the consumption of the side surface of the electrode which can be considered a real loss is so large as has been clarified from the above description, which leads to increased electrode unit consumption, resulting in production cost increase.

The consumption resulting from lateral oxidation is utterly useless. Naturally there have been several steps of activity for saving the graphite electrode from useless consumption as mentioned above. The first step was a use of protective coating. It resulted in a reduction of graphite consumption by 12–15%. However, its process, being followed by some disadvantages, required some reconstruction and adaption as well as investments in arc furnaces. The next step was to eliminate side oxidation. By 1912, such electrodes as were made from metal shafts in the upper part and graphite rods as the tip had been patented.

Disadvantage of an early water cooled combination electrode was that there was no protection against a short circuiting of an arc that occurred between scraps and metal electrodes and that such a short circuiting might produce some molten holes in a metal electrode letting water flow into a furnace vessel. Thus, this method, having risk of producing serious explosion accidents, proved to be unusable.

Next development was, to substitute only one electrode out of the graphite column to a water cooled metal system. It is the electrode on top of the column which ends in the brackets of the holder. Only a slight change to existing use of total graphite columns is required. The savings are comparatively small. They are similar to those using coated electrodes.

The further developed method is provided with electrodes of about 4–5 meters insulated by high temperature resistant ceramic material, the upper parts of which are water cooled too. The active part between a metal part and an arc is made from graphite. There is no problem of short circuiting as long as the electrical and thermal insulating ceramics withstand the corrosion due to slag and scraps. But in a short time after usage, cooled slag would build up thick layers on the cooled ceramic insulating material and cause corrosion and damages. The risk that whole areas of the insulation fall down and a free metal surface can build up short circuiting is extremely high.

In operation is another variation of combination electrodes. The long water cooled metal shaft is covered in the area where slag particles can hit the column and cool down in contact with the system with graphite rings. Only the ring next to active graphite rod on tip on the total electrode unit is fixed by thread to the metallic part. On the graphite rings the slag is not kept and falls down.

All these apparatuses are so complicated that they need services from outside the furnace, which leads to downtime and loss of productivity. In addition, they require relatively high investment costs.

OBJECT AND SUMMARY OF THE INVENTION

The present invention is intended to solve the above-mentioned problems by means of reducing electrode temperature rise by forcibly cooling the surface of graphite electrodes exposed to the outside of the furnace so as to prevent the side surface of the electrode inside the furnace from being oxidized, and the purpose of the present invention is to provide a cooling apparatus for electric arc furnace (EAF) electrodes in which the following effects and/or advantages can be expected:

(1) Oxidation of electrode surfaces can be prevented by cooling the surfaces of the electrodes, contributing to reduce electrode unit consumption by approx. 15% and also production cost;

(2) Service life of the refractories at the center roof can be extended by approx. 50%, without being followed by arcing to metal section as usually seen in the conventional water cooled combination electrodes;

(3) Only a header has to be provided at the lower part of an electrode holder and only another header has to be provided around an electrode hole on a furnace roof, the cost of which is so low as compared with resultant electrode cost saving;

(4) The apparatus structure is so simple that it effects low investment cost;

(5) The apparatus operates automatically with easy maintenance to effect almost no maintenance cost;

(6) As the nozzles of this apparatus produce a uniform spray of foggy water or solution onto the surfaces of the electrodes to effect a uniform cooling of the electrodes;

(7) Cooling water consumption is smaller than those in other types of water cooled combination electrode apparatus;

(8) As spraying conditions including spraying amount and time can be controlled optimumly for EAF operation, damage of electrodes, inclusion of water into scraps and/or molten steel, and loss of water can be prevented;

(9) The electrodes within the furnace are cooled indirectly from outside the furnace, the heat loss within the furnace can be minimized;

(10) As the electrodes under the holders do not wear, electrode breakage trouble decreases; and

(11) The apparatus can be adapted to any sized EAF.

In brief, my invention contemplates a cooling apparatus for electric arc furnace (EAF) electrodes, in which nozzles spray and cool the surfaces of EAF electrodes outside the furnace roof. The water spray cooling is provided around the graphite electrode columns. Water flow is controlled in a way that water running down the electrode columns is evaporated before entering EAF-roof hole to enable maximum graphite saving and high security.

Characteristic feature is that the nozzles to spray and cool the surfaces of EAF electrodes jutting upward at outside the furnace roof are provided around the electrodes.

Spray rings made from stainless steel in a non-closed circular shape for preventing induction heating have nozzles designed to function as the above. Each of these rings is fitted to the lower part of an electrode holder. Numbers, size, and mutual distance of the nozzles depend on the temperature profile of the graphite electrode columns. Water flow ranges from 1.4 to 5 $m^3$/hour and the phase depends on the thermic situation of the columns. Water pressure varies between 1.5 and 3.5 $kg/cm^2$ at the inlet to the water piping system of the cooling apparatus on the furnace.

DESCRIPTION OF THE PREFERRED EMBODIMENT

An example for carrying out the invention is described referring to the attached drawings.

Figure 1:
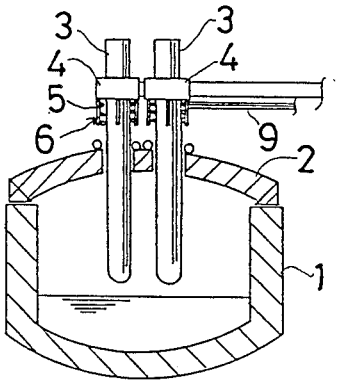
FIG. 1 is a sectional view of a typical embodiment of the present invention.
Figure 2:
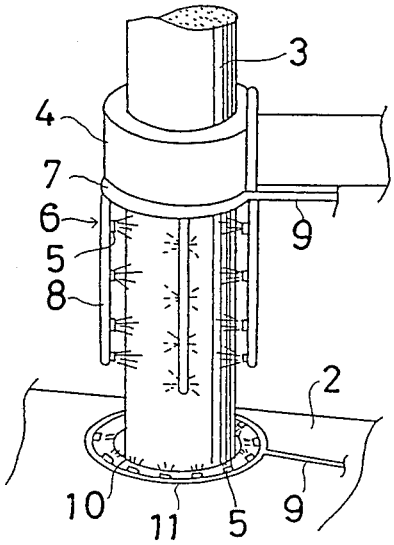
FIG. 2 is an enlarged perspective view of the essential part of said typical embodiment of the present invention.
Figure 4:
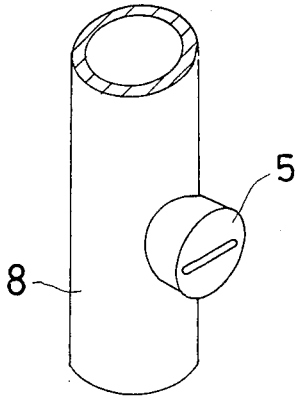
FIG. 4 is a fragmentary enlarged perspective view showing a vertical pipe and a nozzle of a typical embodiment of the present invention.

FIG. 1 shows the whole apparatus of the present invention, and FIG. 2 is an enlarged perspective view of the essential part of the present invention. 1 is a furnace shell, 2 is a furnace roof. Electrodes 3 go through the furnace roof 2 so as to move up and down freely. The electrodes 3 are made from graphite. The upper portions of the electrodes which project out of the furnace roof 2 are clamped by electrode holders 4. Spray nozzles 5 to forcibly cool the exterior circumference of the electrodes 3 between the electrode holders 4 and the furnace roof 2 are provided in the exterior circumference areas of the electrodes 3. The spray nozzles 5 are provided on headers 6 fitted to the lower part of the electrode holders 4. As is shown in FIG. 4, the opening portion of each nozzle 5 is oval. The nozzles 5 are the nozzles from which water is sprayed to the electrodes 3 uniformly. The headers 6 consist of ring pipes 7 which are fitted to the lower part of the electrode holders 4 and which encircle the external circumference of the electrodes 3, and the vertical pipes 8 which hang down from the ring pipes 7 along the external circumference surfaces of the electrodes 3. On the vertical pipes 8, the nozzles 5 are provided at certain intervals in the vertical direction. The nozzles 5 are oriented toward the surfaces of the electrodes. To the ring pipes 7, water feed pipes 9 are connected. Cooling water supplied from the water feed pipes 9 is, in turn, supplied to each of the vertical pipes 8 through the ring pipes 7 and sprayed to the surfaces of the electrodes uniformly. For the coolant sprayed from the nozzles 5, ordinary industrial water is mainly used. However, it is also possible to use oxidation preventing agent solution like phosphoric acid, inert gas, etc., in addition to water, so that consumption of the surfaces of the electrodes due to oxidation could be prevented positively.

Spraying time or spraying operation can be switched on and off automatically in accordance with the EAF operating conditions in most cases. That is to say, the spraying operation is switched on and off by the use of limit switches responding to the up-and-down movement of the electrodes.

In the above-mentioned embodiment, another header 11 consisting of a ring pipe is provided around each electrode hole 10 of the furnace roof 2 as the need arises. Inside the header 11, there are spray nozzles 5 oriented to the surface of the electrode.

According to the above-mentioned embodiment of the present invention, when the coolant is sprayed from the spray nozzles 5 to the surfaces of the electrodes 3 above the furnace roof 2, moisture attached to the surfaces of the red-heated electrodes 3 is vaporized instantaneously and the electrodes are cooled at the same time. As the electrodes 3 above the furnace roof 2 are cooled, the electrodes 3 within the furnace are cooled. It must be noted here that the graphite electrodes tend to be oxidized and consumed very rapidly when they are heated up to 600°–700° C. The cooling apparatus of the present invention serves for keeping the temperature of the electrodes 3 within the furnace below about 600° C., by cooling the external surfaces of the electrodes 3 outside the furnace, so as to prevent the electrode consumption due to oxidation beforehand.

The sprayed the coolant is vaporized and evaporated almost instantaneously as mentioned above. Part of it flows into the inside of the furnace along the surfaces of the electrodes 3 but the moisture is vaporized completely owing to the high temperature atmosphere within the furnace. Therefore, there is no risk at all that some moisture goes into the scrap and/or molten steel within the furnace.

Essential parts of the total cooling apparatus of the present invention are the design of the spray nozzles 5 as shown in FIG. 4 and the number of the nozzles under each ring pipe 7 in relation to temperature profile of graphite electrode columns in the electric arc furnace. Wrong nozzle design will reduce effectivity of the apparatus in view of graphite electrode saving and therefore total economy.

EXAMPLE

The results obtained from the test carried out on the aforementioned embodiment of the present invention are as follows:

| Typical application results |
|---|
| (1) "S" steel mill (60 ton EAF): |
| (a) Rough equipment specification: |
| * Actual tapping steel: 90 ton |
| * Furnace shell diameter: 5800 mm |
| * Furnace transformer: 45/54 MVA |
| * Electrode diameter: 20" |
| (b) Unit consumption: |

-continued

| Typical application results |
|---|
| * Reduction in electrode unit consumption: |
| 2.6 kg/ton → 2.2 kg/ton |
| Reduction by 0.4 kg/ton |
| * Reduction in unit consumption of refractories at center roof: |
| Service life before application of this apparatus: 350 heats |
| Unit consumption before application of this apparatus: Approx. 0.17 kg/ton |
| Service life after application of this apparatus: 525 heats |
| Unit consumption after application of this apparatus: Approx. 0.12 kg/ton |
| Reduction by 0.05 kg/ton |
| (2) "T" steel mill (200 ton EAF): |
| (a) Rough equipment specification: |
| * Actual tapping steel: 190 ton |
| * Furnace shell diameter: 8000 mm |
| * Furnace transformer: 70/82 MVA |
| * Electrode diameter: 24" |
| (b) Unit consumption: |
| * Reduction in electrode unit consumption: |
| 2.2 kg/ton → 1.9 kg/ton |
| Reduction by 0.3 kg/ton |
| * Reduction in unit consumption of refractories at the center roof: |
| Service life before application of this apparatus: 150 heats |
| Unit consumption before application of this apparatus: Approx. 0.28 kg/ton |
| Service life after application of this apparatus: 450 heats |
| Unit consumption after application of this apparatus: Approx. 0.09 kg/ton |
| Reduction by 0.19 kg/ton |

This invention may be practiced or embodied in still other ways without departing from the spirit or essential character thereof.

Figure 3:
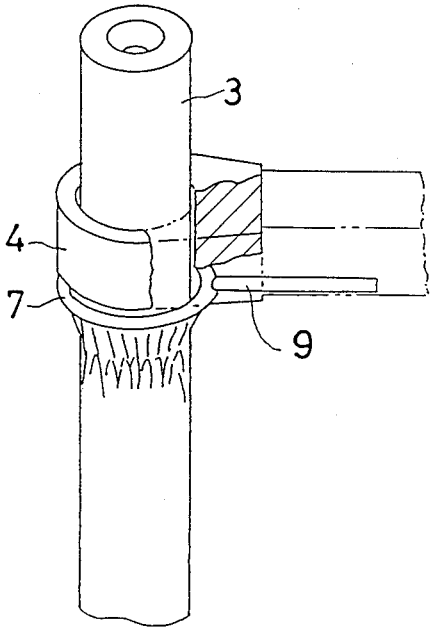
FIG. 3 is a fragmentary enlarged perspective view of a more specific embodiment of the present invention.

For instance, FIG. 3 shows an apparatus for cooling an electrode 3 by spraying the cooling supplied by a feed pipe 9 using spray nozzles provided directly on a ring pipe 7 fitted to the lower part of an electrode holder 4.

Figure 5:
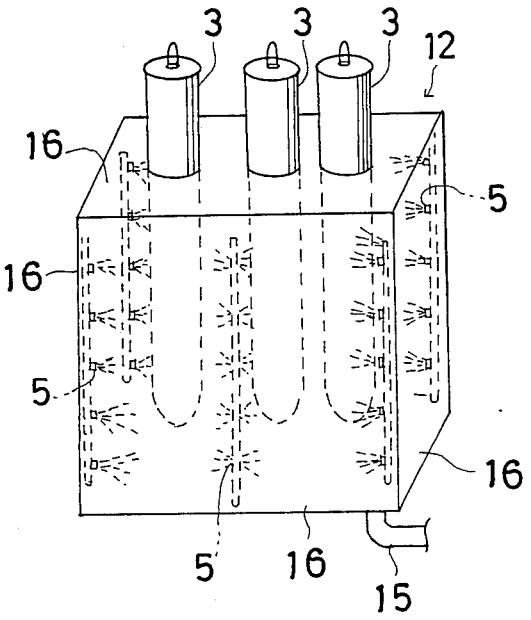
FIG. 5 and FIG. 6 are fragmentary perspective views showing apparatuses for cooling electrodes at outside of a furnace.
Figure 6:
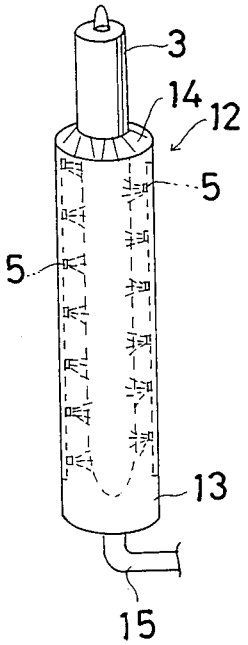

FIG. 5 and FIG. 6 show still additional embodiments, i.e., apparatuses 12 for cooling electrodes outside a furnace. When the electrodes 3 are taken out of the furnace to be connected with new electrodes and electrode addition is done outside the furnace, or when the electrodes 3 are taken out of the furnace for repairing of the furnace or for some other troubles, said apparatuses are used for forcibly cooling the surfaces of the electrodes 3 by forming water film in order to prevent oxidizing of the electrodes.

In these, FIG. 5 shows that the existing electrode installed place is enclosed with steel plates 16 and water film for forcible cooling is formed on used electrodes 3 by the use of spray nozzles 5 provided inside the steel plate enclosure.

FIG. 6 shows that the electrode 3 after being used is inserted into a cylindrical cover 13, whose upper part is sealed with a sealing material 14 and cooling water is sprayed to the surface of the electrode 3 from spray nozzles 5 within the cylindrical cover 13 to make water film for cooling purpose. 15 is a drain pipe provided at the lower part of the cylindrical cover 13.

By the use of the cooling apparatuses illustrated in FIG. 5 and FIG. 6 oxidizing due to natural cooling of the electrodes after used can be prevented.

What is claimed is:

1. An apparatus for cooling graphite electrodes extending through a roof of an electric arc furnace (EAF) which comprises means capable of spraying a cooling agent onto an outer surface of a portion of said electrodes extending to an outside of the EAF roof, in which said coolant includes an antioxidant treatment which protects said graphite electrodes.

2. An apparatus in accordance with claim 1, in which said antioxidant is selected from a group consisting of phosphoric acid, nitrogen and argon.

3. An apparatus for cooling graphite electrodes extending through a roof of an electric arc furnace (EAF) which comprises means capable of spraying a cooling agent onto an outer surface of a portion of said electrodes extending to an outside of the EAF roof, in which said cooling agent is sprayed at a flow rate between 1.5 to 5.0 $m^2$/hour, and at a pressure between 1.5 and 3.5 $kg/cm^3$.

4. An apparatus in accordance with claim 3, which includes control means for controlling the coolant flow rate in accordance with an operating program based on electrical and operational data of said furnace for optimized use of cooling agent from an economic and safety viewpoint.

5. An apparatus for cooling graphite electrodes extending through a roof of an electric arc furnace (EAF) which comprises means capable of spraying a cooling agent onto an outer surface of a portion of said electrodes extending to an outside of the EAF roof, wherein said means for spraying a cooling agent onto said graphite electrodes includes a spray ring formed of nonmagnetic materials, and said cooling agent is sprayed at a flow rate between 1.5 to 5.0 $m^2$/hour, and at a pressure between 1.5 to 3.5 $kg/cm^3$.

6. An apparatus in accordance with claim 5, which includes a control means for controlling coolant flow rate in order to assure evaporation of coolant from the surface of said graphite electrodes before entering a critical area in the furnace.

7. An apparatus for cooling graphite electrodes extending through a roof of an electric arc furnace (EAF) which comprises means capable of spraying a cooling agent onto an outer surface of a portion of said electrodes extending to an outside of the EAF roof, wherein said means includes spray nozzles secured to a ring at certain angles which insure that said cooling agent reaches portions of said graphite electrodes, wherein said cooling agent is sprayed at a flow rate between 1.5 to 5.0 $m^2$/hour, and at a pressure between 1.5 to 3.5 $kg/cm^3$.

8. An apparatus in accordance with claim 7, which includes a control means for controlling coolant flow rate in order to assure evaporation of coolant from the surface of said graphite electrodes before entering a critical area in the furnace.

* * * * *